United States Patent [19]

Achtenberg et al.

[11] Patent Number: 4,563,852

[45] Date of Patent: Jan. 14, 1986

[54] METHOD OF REINFORCING CONCRETE BLOCK FOUNDATION WALLS

[76] Inventors: Irving Achtenberg, 1028 W. Seventieth St., Kansas City, Mo. 64113; Otto W. Fleck, 1102 Essex St., Liberty, Mo. 64068

[21] Appl. No.: 684,944

[22] Filed: Dec. 21, 1984

[51] Int. Cl.[4] ..... E04G 23/02; E04D 37/00

[52] U.S. Cl. ..... 52/743; 52/293; 52/514

[58] Field of Search ..... 52/291, 293, 294, 225, 52/226, 742, 743, 169.6, 514, 127.4, 127.7, 640

[56] References Cited

U.S. PATENT DOCUMENTS

| | | | |
|---|---|---|---|
| 377,940 | 2/1888 | Hevner | 52/514 |
| 1,704,255 | 3/1929 | Lewis | 52/293 |
| 2,684,589 | 7/1954 | Perreton | 52/293 |
| 3,537,220 | 11/1970 | Ellis | 52/225 |
| 4,353,194 | 11/1982 | Norton | 52/514 |
| 4,452,028 | 6/1984 | Norton et al. | 52/744 |

*Primary Examiner*—James L. Ridgill, Jr.

*Attorney, Agent, or Firm*—Kokjer, Kircher, Bradley, Wharton, Bowman & Johnson

[57] ABSTRACT

A method by which a concrete block foundation wall is strengthened and reinforced. Upper and lower access openings are chiseled in the wall to provide access to a vertical passage formed by aligned cavities in the blocks. A lower anchor bolt is inserted through the lower opening and anchored to the foundation wall footing at the bottom of the passage. An upper bolt is inserted through the upper opening and extended through the wood plate which rests on top of the wall. A nut is threaded onto the upper bolt. A flexible steel cable is inserted into the passage through the upper opening and fastened to the upper bolt at one end and to the lower bolt at the other end. The nut is then tightened on the upper bolt to place the cable in a taut condition. A spacer is inserted through an intermediate opening in the wall and used to deflect the cable to a bowed shape. The passage is then filled with cement to form a vertical column of cement reinforced by the steel cable.

20 Claims, 3 Drawing Figures

METHOD OF REINFORCING CONCRETE BLOCK FOUNDATION WALLS

BACKGROUND OF THE INVENTION

This invention relates in general to the repair of foundation walls and more particularly to a method of strengthening and reinforcing concrete block foundation walls.

The foundation walls of residential buildings are commonly constructed of concrete blocks which are stacked in staggered courses and bound together by mortar. Although concrete block walls are strong in compression, they have little tensile strength and are much more vulnerable to lateral forces than solid concrete foundation walls. For example, when the foundation wall is fully or partially below ground, as is often the case, it is acted upon by the soil which is back filled against the foundation. Considerable lateral forces can be exerted against the wall by expanding soil and also by hydrostatic pressure. It is not uncommon for these forces to cause the foundation wall to bow inwardly and develop cracks, primarily in the horizontal mortar joints which are especially susceptible to damage. In extreme cases, the entire wall can buckle and cause extensive structural damage to the foundation and the overlying building.

In order to overcome this problem, methods have been proposed for strengthening and reinforcing a concrete block foundation wall after the foundation and the overlying building have been constructed. Such methods typically involve the insertion of steel reinforcing rods into the vertical channels or passages that are formed within the wall by the aligned cavities in the individual blocks. During construction, rods can be installed from the top without great difficulty. However, once the building has been completed, it is necessary to open up the wall from the basement side in order to gain access to the passages for installation of the reinforcing rods. As disclosed in U.S. Pat. No. 4,353,194 to Norton, one or more large openings must be formed in the basement wall so that reinforcing bars can be inserted into the interior wall passages. The need to form large openings in the wall requires considerable time and effort, both in chiseling the openings and in repairing them at the end of the procedure. Even more importantly, the relatively large amount of material that is broken away from the blocks during formation of the openings detracts significantly from the overall strength of the wall. Therefore, the formation of large access openings in the wall is highly undesirable and should be avoided if possible.

SUMMARY OF THE INVENTION

The present invention is directed to an improved method of strengthening and reinforcing a concrete block foundation after the foundation and the overlying building have been fully constructed. In accordance with the invention, two relatively small access openings are formed in the inside surface of the foundation wall at its top and bottom. The lower opening provides access for the installation of an anchor bolt which is set in the concrete footing at the bottom of the passsage. At the top of the passage, another bolt is installed through the wood plate which overlies the foundation wall. A large washer and a nut are applied to the upper bolt. A flexible steel cable or chain is then inserted into the channel through the upper access opening and is secured at one end to the upper bolt by a cable clamp. The opposite end of the cable is thereafter secured to the lower anchor bolt by another cable clamp, and the nut is then tightened to place the cable in a taut condition.

The cable or chain serves as reinforcement and functions more effectively if it bows or curves inwardly near its center. Accordingly, it is preferred that a spacer be used to force the center of the chain inwardly somewhat toward the basement side of the wall. A third access opening can be formed in the wall at the desired location to provide access for insertion of the spacer. After the chain has been installed, the passage in the wall is filled with cement which can be applied through the access openings. When the cement has set, an internal column of cement is formed within the wall and is reinforced by the chain which binds the courses of block together and resists further deflection or buckling of the foundation wall.

DETAILED DESCRIPTION OF THE INVENTION

Figure 2:
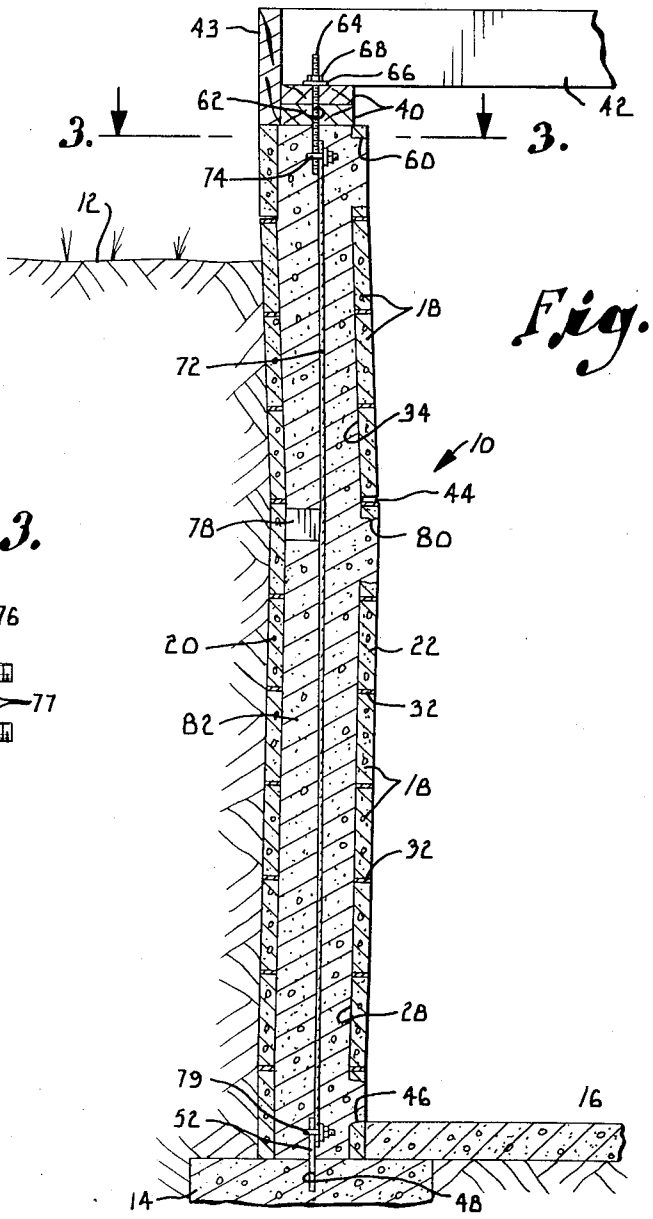
Figure 3:
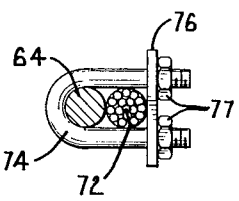
Figure 1:
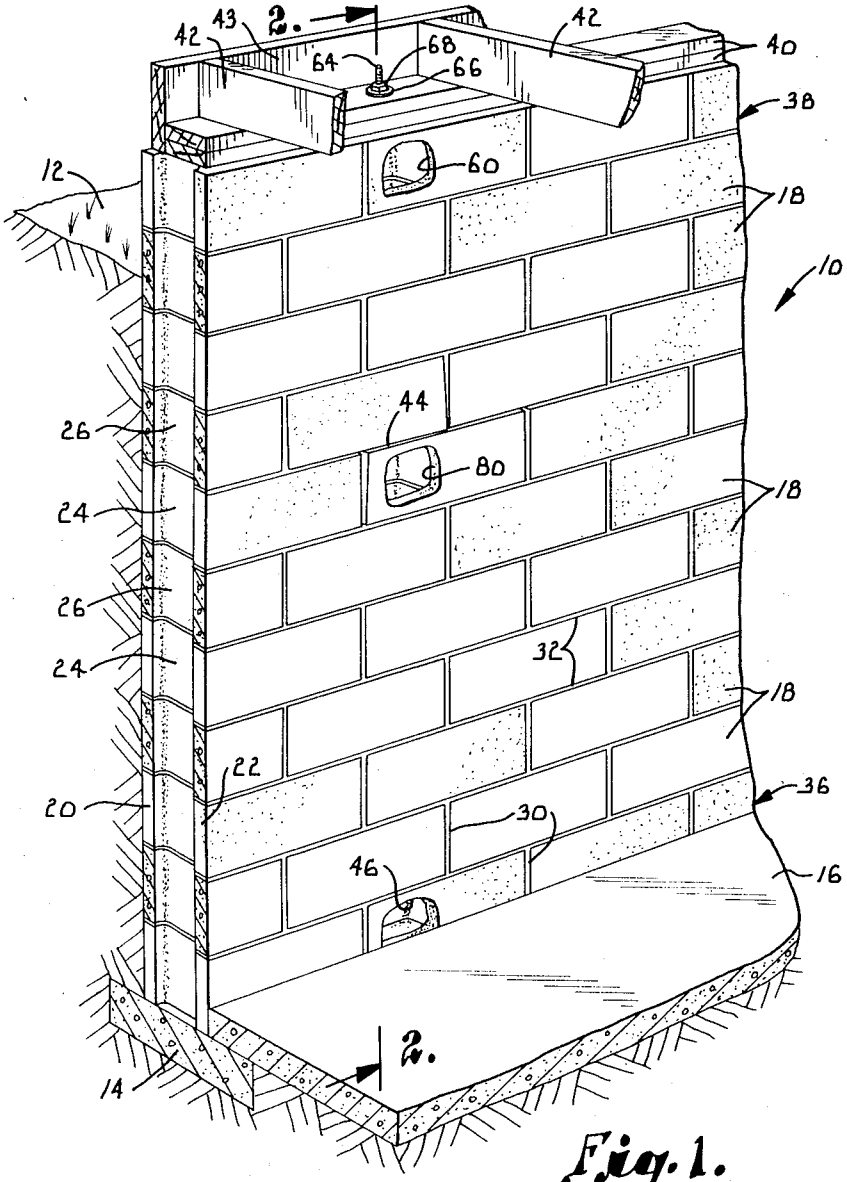

In the accompanying drawing which forms a part of the specification and is to be read in conjunction therewith and in which like reference numerals are used to indicate like parts in the various views:

FIG. 1 is a cutaway perspective view of a concrete block foundation wall which has been reinforced in accordance with the method of the present invention; and FIG. 2 is a sectional view through the foundation wall taken generally along line 2—2 of FIG. 1 in the direction of the arrows; and FIG. 3 is a fragmentary sectional view on an enlarged scale taken generally along line 3—3 of FIG. 2 in the direction of the arrows.

Referring now to the drawing in more detail, numeral 10 generally designates a concrete block foundation wall of the type commonly used in the construction of residential and other buildings. The foundation wall 10 is for the most part located below the level of the adjacent soil 12. A concrete footing 14 supports the wall 10. A concrete slab 16 is located at the base of the wall 10 inside of the basement to form a basement floor. The slab 16 rests on the concrete footing 14.

The foundation wall 10 is constructed of a plurality of conventional concrete blocks 18 each having a generally rectangular configuration. Each block 18 has an outer side wall 20 and an inner side wall 22. End walls 24 extend between the side walls 20 and 22 at the opposite ends of each block. A center web 26 extends across the center of each block 18 between the side walls 20 and 22. Between the center web 26 and each end wall 24, a generally square open cavity 28 is formed. Each block 18 has two of the cavities 28 located side by side.

In constructing the foundation wall 10, the concrete blocks 18 are arranged end to end in rows or courses which are stacked on top of one another. The adjacent blocks in each course are bound together end to end by vertical mortar joints 30. Each block 18 is also bound to the adjacent blocks in the underlying and overlying courses by horizontal mortar joints 32. Each course of blocks is staggered relative to the underlying and overlying course by a distance equal to half the length of a block. Consequently, the left cavity 28 of each block is aligned with the right cavity in the immediately underlying and immediately overlying block. The aligned cavities cooperate to form a plurality of continuous vertical channels or passages 34. The vertical passages 34 are located side by side and extend the entire height of the foundation wall 10. The end walls 24 and center webs 26 separate the passages 34 from one another.

The bottom course of concrete blocks is designated by numeral 36 in FIG. 1 and is located directly on the footing 14 and partially below the upper surface of the basement floor 16. The top course of blocks is designated by numeral 38 and is provided with one or more overlying wood plates 40 which normally take the form of 2×6 boards. The plates 40 cover the top ends of the internal passages 34. The lower plate 40 may take the form of a cap formed by solid blocks. In any event, the floor of the building which is supported on the foundation wall 10 includes parallel floor joists 42 secured at their ends by band joists 43.

Due to the expansion of the adjacent soil caused by thermal variations and other natural conditions, including hydrostatic pressure, it is not uncommon for the foundation wall 10 to bow inwardly and to develop cracks such as the crack 44 extending along one of the horizontal mortar joints 32. The development of cracks can result in serious problems such as the leakage of water through the basement wall and can significantly impair the structural integrity of the foundation wall. The present invention provides a method by which the wall can be strengthened and reinforced after the wall and the overlying building have been fully constructed.

The first step is to form a small access opening 46 in the bottom course 36. The opening 46 provides access to the bottom portion of passage 34 is made through the inner wall 22 of the block 18 which is aligned below the crack 44 or other damaged area. The opening 46 may be formed by chiseling or in any other suitable manner and is located immediately above the upper surface of the basement floor 16.

A suitable hole 48 is drilled in the footing 14 at the bottom of passage 34, with the opening 46 providing access for formation of the hole. An anchor bolt 52 is inserted into the drilled hole 48 and is preferably an expanding type bolt which can be expanded within the hole to anchor the bolt securely to the footing.

An upper access opening 60 is then formed in the top course 38 directly above the lower opening 46. The opening 60 is formed in the inner wall 22 of the block and provides access to the top end of the same vertical channel 34 into which the lower access opening 46 opens. Opening 60 can likewise be formed by chiseling or in any other suitable manner.

A 90° drill (not shown) or another tool can be inserted through the upper access opening 60 and used to bore a vertical passage 62 through the two wood plates 40 which rest on top of the foundation wall 10. After the passage 62 has been bored and the tool has been removed, an upper bolt 64 is inserted through the access opening 60 into the top portion of the passage 34. The shank of the anchor bolt 64 is then passed upwardly through passage 62 until its threaded top end is accessible from above the upper plate 40. A large flat washer 66 and a nut 68 are then applied to the upper end of bolt 64 in order to secure it to the plates 40. Bolt 64 may be an "all thread" bolt.

Next, a flexible steel cable 72 is installed in the vertical passage 34. Cable 72 is inserted through the upper opening 60, and its top end is secured to the upper bolt 64 by a conventional cable clamp 74. As shown in FIG. 3, the cable clamp 74 has a U shaped body threaded at the end of each leg. A clamp element 76 may be tightened on the legs of the body to clamp the bolt 64 and cable 72 together by tightening a pair of nuts 77. The chain is thus suspended in the passage from the upper anchor bolt 64. The flexibility of the link cable 72 permits it to be inserted through the relatively small upper access opening 60.

If excess mortar or another obstruction is present to prevent the cable 72 from dropping completely through the passage 34, the passage must be cleared in order to permit the chain to extend down to the lower anchor bolt 52. Any obstructions that are present are removed by forming one or more additional access openings (not shown) in the inside surface of the foundation wall at the appropriate locations. When the passage 34 has been cleared of all obstructions, it is completely open and clean from top to bottom, and the lower end of the cable 72 is accessible by reaching through the lower access opening 46. In each case, it is desirable to minimize the number of access openings that must be formed in the foundation wall.

Once the passage 34 has been cleared and the lower end of cable 72 has dropped to the bottom of the passage, the lower end portion of the cable is reached through the lower access opening 46 is secured to the lower anchor bolt 52 by a cable clamp 79 which may be identical to the cable clamp shown in FIG. 3. After the clamp 79 has been tightened to secure cable 72 to bolt 52, the nut 66 on the upper bolt 64 is tightened to place the cable 72 in a taut condition. Tightening of the nut 66 draws the upper bolt upwardly and thereby increases the tension in the cable until the desired tension is achieved.

It has been found that the cable 72 provides stronger and more effective reinforcement if it is bowed somewhat toward the basement side. Accordingly, a spacer 78 is preferably used to force the center of the cable inwardly somewhat toward the basement side of the wall such that the center of the cable is closer to the inside surface than the ends of the cable. In order to permit the spacer 78 to be inserted into the passage 34, an intermediate access opening 80 is chiseled or otherwise formed in the inside wall 22 of a selected block 18 in one of the intermediate courses of blocks. Opening 80 is aligned with the upper and lower openings 60 and 46 to provide access to the passage 34 in which cable 72 extends. The spacer 78 can be inserted through the intermediate access opening 80 and wedged between the cable 72 and the outside wall 20 of the block. The spacer can be suitably connected to the cable and/or to the wall 20 if desired.

Finally, the passage 34 is filled with cement from top to bottom to form an internal concrete column 82 which extends the entire height of the passage 34. The cement 82 can be inserted through the access openings 46, 80 and 60. The cement is allowed to set up to form the column 82, and the access openings are trowelled to provide a smooth finish. The joints are also pointed, and the inside surface of the wall is ultimately restored to its original appearance.

The cable 72 is embedded in the concrete column 82, and the internal column formed within the wall 10 bonds the wall in the manner of reinforced concrete. The cable 72 is in a tense condition to bind the successive courses of block and essentially band them together. The overall result is that the internal column of steel reinforced concrete strengthens and reinforces the foundation wall 10 prevents further bowing or buckling of the wall.

Additional reinforced concrete columns can be formed in the same manner in other of the vertical passages 34 if necessary or desired. The method of this invention can also be carried out before any bowing or other damage to the wall has taken place.

If desired, a steel link chain (not shown) can be used in place of the steel cable 72. The ends of the chain can be suitably secured at the top and bottom ends of the passage 34, and the chain can be placed in a tense condition in the same manner described in connection with the cable. We have found that space limitations normally make a cable easier to apply.

Because of the flexibility of the cable 72 (or the chain) used as the steel reinforcement member, only relatively small access openings need be formed in the foundation wall 10. Due to its flexibility, the wire cable or chain can be inserted through a relatively small upper access opening, and the lower and intermediate openings 46 and 80 need only be large enough to provide access for carrying out the operations described above. Normally, it is necessary to provide only three access openings, all of which can be quickly and easily formed and quickly and easily repaired and finished due to their small size. At the same time, the small size of the access openings results in only a relatively small amount of material being chiseled out of the basement wall during the repair procedure.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. A method of reinforcing a foundation wall formed by stacked blocks cooperating to present a generally vertical passage within the wall, said method comprising the steps of:

forming upper and lower openings in the wall each providing access to the passage;

inserting upper and lower anchor elements into the passage through the respective upper and lower openings;

anchoring the upper and lower anchor elements in the passage adjacent the respective upper and lower openings;

inserting an elongate flexible member into the passage through the upper opening and suspending said member from the upper anchor element with one end portion of the flexible member secured to the upper anchor element and the flexible member extending within the passage between the upper and lower anchor elements;

securing said flexible member to the lower anchor element to maintain the flexible member in a taut condition; and substantially filling the passage with cement in which the flexible member is embedded when the cement sets, thereby providing a column of cement in the passage reinforced by said flexible member.

2. The method of claim 1, wherein the foundation wall stands on a footing and the step of anchoring the lower anchor element in the passage comprises drilling a hole in the footing and anchoring the lower anchor element in said hole.

3. The invention of claim 1, wherein the wall has an overlying plate and the step of anchoring the upper anchor element comprises:

forming a generally vertical opening in said plate;

inserting the upper anchor element through said vertical opening from within the passage; and applying a fastener to said upper anchor element from above the plate, thereby securing the upper anchor element to the plate.

4. The invention of claim 3, wherein said upper anchor element extends below the plate and includes a threaded shank extending through said vertical opening, and said step of applying a fastener comprises threading a nut onto said shank.

5. The invention of claim 4, including the step of tightening said nut on the threaded shank to place said flexible member in a taut condition after the step of securing said flexible member to the lower anchor element but before the step of substantially filling the passage with cement.

6. The invention of claim 5, including the step of deflecting said flexible member into a bowed shape while the member is in said taut condition.

7. The invention of claim 6, wherein said deflecting step comprises:

forming an intermediate opening in the wall providing access to the passage at a location between the upper and lower openings;

inserting a spacer into the passage through said intermediate opening; and engaging said spacer against said flexible member to deflect an intermediate portion thereof in a direction to effect and maintain said bowed shape of the flexible member.

8. The invention of claim 5, wherein the foundation wall stands on a footing and said step of anchoring the lower anchor element comprises:

drilling a hole in the footing at the bottom of said passage; and anchoring the lower anchor element in said hole.

9. The invention of claim 1, including the step of increasing the tension of the flexible member after same has been secured to the lower anchor element.

10. The invention of claim 9, wherein said tension increasing step comprises adjusting the upper anchor element upwardly.

11. The invention of claim 1, including the step of deflecting said flexible member into a bowed shape while said member is in said taut condition.

12. The invention of claim 11, wherein said deflecting step comprises:

forming an intermediate opening in the wall providing access to the passage at a location between the upper and lower openings;

inserting a spacer into the passage through said intermediate opening; and applying the spacer between an intermediate portion of the flexible member and a selected surface of the wall to deflect said intermediate portion away from said selected wall portion.

13. A method of reinforcing a building foundation wall having inside and outside surfaces and a generally vertical passage extending within the wall, said method comprising the steps of:

forming upper and lower openings in the inside surface of the wall each providing access to the passage from the inside wall surface;

inserting upper and lower anchor elements into the passage through the respective upper and lower openings;

anchoring the upper and lower anchor elements in the passage adjacent the respective upper and lower openings;

inserting an elongate flexible member into the passage and securing opposite end portions of said member to the upper and lower anchor elements to retain the flexible member in the passage in a taut condition;

forming an intermediate opening in the inside surface of the wall at a location to provide access to the passage between the upper and lower openings;

inserting a spacer into the passage through said intermediate opening and engaging said spacer against an intermediate portion of said flexible member in a manner to maintain said member in a bowed shape with said intermediate portion being closer to said inside surface than said end portions; and inserting cement into the passage to form a cement column therein reinforced by said flexible member when the cement sets with the flexible member embedded therein.

14. The method of claim 13, wherein the step of inserting said flexible member into the passage and securing the opposite end portions thereof comprises:

inserting one end portion of the flexible member through the upper opening and attaching said one end portion to the upper anchor element;

dropping the flexible member in the passage to suspend said member therein with the opposite end portion accessible through the lower opening; and reaching through said lower opening and attaching the opposite end portion of the flexible member to the lower anchor element.

15. The method of claim 14, including the step of adjusting the upper anchor element away from the lower anchor element to increase the tension of the flexible member, whereby to place same in said taut condition.

16. The method of claim 14, wherein the upper anchor element is a threaded and the foundation wall includes an overlying plate, said step of anchoring the upper anchor element comprising:

forming a vertical opening through the plate;

inserting the upper anchor element through said vertical opening from below the plate with said upper anchor element extending below the plate at the top of the passage; and threading a nut onto said upper anchor element from above the plate.

17. The method of claim 16, including the step of tightening said nut on said shank after the end portions of the flexible member have been attached to the upper and lower anchor elements, thereby increasing the tension of the flexible member to place same in said taut condition.

18. A method of reinforcing a building foundation wall formed by stacked blocks cooperating to present a vertical passage within the wall extending between a footing on which the blocks are stacked and a plate which overlies the blocks, said method comprising the steps of:

forming a lower opening in the wall to provide access to the passage at a location adjacent the footing;

inserting a lower anchor element through said lower opening and anchoring the lower anchor element at the bottom end of the passage;

forming an upper opening in the wall to provide access to the passage at a location adjacent the plate;

forming a hole in said plate in alignment with the passage;

inserting an upper anchor element into the upper opening and passing a threaded shank of the upper anchor element through the hole in the plate;

applying a nut to said threaded shank at a location above the plate, whereby tightening of the nut draws said upper anchor element upwardly;

inserting an elongate flexible member into the passage through the upper opening and securing one end portion of said flexible member to the upper anchor element;

securing the opposite end portion of said flexible member to the lower anchor element;

tightening said nut to effect a taut condition of the flexible member; and substantially filling the passage with cement to form a column of cement therein with said flexible member embedded in the column to reinforce same.

19. The invention of claim 18, including the step of deflecting said flexible member into a bowed shape after the nut has been tightened to effect the taut condition of the flexible member.

20. The invention of claim 19, wherein said deflecting step comprises:

forming an intermediate opening in the wall providing access to the passage at a location between the upper and lower openings;

inserting a spacer into the passage through said intermediate opening; and applying the spacer between an intermediate portion of the flexible member and a selected surface of the wall to deflect said intermediate portion away from said selected wall portion.

* * * * *